US007321376B2

(12) United States Patent
Han

(10) Patent No.: US 7,321,376 B2
(45) Date of Patent: Jan. 22, 2008

(54) THERMAL PRINTER

(75) Inventor: Dong-Hun Han, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 262 days.

(21) Appl. No.: 11/247,266

(22) Filed: Oct. 12, 2005

(65) Prior Publication Data

US 2006/0092261 A1 May 4, 2006

(30) Foreign Application Priority Data

Oct. 28, 2004 (KR) ..... 10-2004-0086548

(51) Int. Cl.
*B41J 2/32* (2006.01)
*B41J 3/60* (2006.01)

(52) U.S. Cl. ..... 347/171

(58) Field of Classification Search ..... 347/171, 347/172, 174–176

See application file for complete search history.

(56) References Cited

U.S. PATENT DOCUMENTS

| | | | | |
|---|---|---|---|---|
| 6,705,786 | B2 * | 3/2004 | Trovinger | 400/645.3 |
| 2002/0001027 | A1 | 1/2002 | Sugioka et al. | |
| 2003/0112315 | A1 | 6/2003 | Hetzer et al. | |
| 2004/0056926 | A1 | 3/2004 | Samoto | |
| 2005/0140770 | A1 * | 6/2005 | Kang et al. | 347/198 |
| 2005/0276649 | A1 * | 12/2005 | Min | 400/120.16 |
| 2006/0023057 | A1 * | 2/2006 | Jung | 347/179 |
| 2006/0092260 | A1 * | 5/2006 | Min | 347/209 |
| 2006/0238601 | A1 * | 10/2006 | Nam | 347/197 |

FOREIGN PATENT DOCUMENTS

| | | |
|---|---|---|
| EP | 0 873 879 | 10/1998 |
| JP | 04-284281 | 10/1992 |
| JP | 08-039859 | 2/1996 |
| JP | 08-337029 | 12/1996 |
| JP | 10-258561 | 9/1998 |
| JP | 10-264477 | 10/1998 |
| JP | 10-315567 | 12/1998 |
| JP | 11-078083 | 3/1999 |
| JP | 2004-122646 | 4/2004 |

* cited by examiner

*Primary Examiner*—Huan Tran
(74) *Attorney, Agent, or Firm*—Rovlance, Abrams, Berdo & Goodman, LLP

(57) ABSTRACT

A thermal printer is provided including a cable which connects a main board and a recording head to form an image on a print medium by heating both surfaces of the print medium. The thermal printer includes a rotating unit rotatably installed within a frame. The thermal printer also includes a recording head, a support member, and a main board installed on the frame substantially above the first surface of the print medium. The main board applies power and provides image data to the recording head. A flexible cable is disposed on one side or both sides of the print medium so as to not to interfere with a transfer of the print medium and a reciprocating rotation of the recording head. The flexible cable connects the main board and the recording head. A control guide is disposed on a path where the flexible cable moves within the frame to control a degree to which the flexible cable is loosened when the recording head is located at a certain position.

19 Claims, 7 Drawing Sheets

THERMAL PRINTER

CROSS-REFERENCE TO RELATED APPLICATIONS

This application claims the benefit of Korean Patent Application No. 10-2004-0086548, filed on Oct. 28, 2004, the entire disclosure of which is hereby incorporated by reference.

BACKGROUND OF THE INVENTION

1. Field of the Invention

The present invention relates to a thermal printer. More particularly, the present invention relates to a thermal printer which includes an improved cable which connects a main board and a recording head to form an image on a print medium via heating.

2. Description of the Related Art

Generally, thermal printers print an image on a thermal imaging print medium by applying heat from a recording head to the print medium. The print medium provides a color image selected according to heating temperatures and duration. The print medium is different from paper, which is typically used as a print medium, and has a structure as illustrated in FIG. 1.

Referring to FIG. 1, the print medium includes a transparent substrate 1. A first image forming layer 2, a spacer 3, a second image forming layer 4, and an upper protection layer 5 are sequentially stacked on an upper surface of the transparent substrate 1. A third image forming layer 6, a reflection layer 7, and a lower protection layer 8 are sequentially stacked on a lower surface of the transparent substrate 1.

The first, second, and third image forming layers 2, 4, and 6, which produce different colors, are formed of yellow, magenta, and cyan leuco dyes, respectively, and a developer. The spacer 3 separates the first image forming layer 2 from the second image forming layer 4 and is transparent so that colors produced in the first and second forming layers 2 and 4 can be recognized when viewed from the upper protection layer 5 side adjacent to the second forming layer 4. The first, second, and third image forming layers 2, 4, and 6 represent colors which respond to different heating temperatures and duration.

To form an image on such a print medium, a conventional thermal printer having a structure as illustrated in FIG. 2 can be used.

Referring to FIG. 2, the conventional thermal printer includes a transfer unit 10 for transferring a print medium M, fixed first and second recording heads 21 and 25 disposed on both surfaces of the print medium M, respectively, and first and second support units 31 and 35 disposed to face the first and second recording heads 21 and 25, respectively. The first and second recording heads 21 and 25 are electrically connected to a main board 40 to receive power and image data from the main board 40.

As described above, in the conventional thermal printer which forms a color image on the print medium M using the two fixed recording heads 21 and 25, the recording heads 21 and 25 can be easily connected to the main board 40 using cables 41 and connectors 45. However, the use of the two recording heads 21 and 25 complicates the thermal printer structure and increases the costs for manufacturing the device.

Hence, there is a need for a thermal printer which forms an image on both surfaces of a print medium by using a single, movable recording medium. However, in this case, since the main board is most likely fixed, and the recording head is movable, cable connections can interfere with the transfer of the printing medium and the size of the thermal printer.

Accordingly, there is a need for improved cable connections that can be made without affecting the transfer of a print medium and the size of the thermal printer.

SUMMARY OF THE INVENTION

An aspect of the present invention is to address at least the above problems and/or disadvantages and to provide at least the advantages described below. Accordingly, an aspect of the present invention is to provide a thermal printer including a cable designed to minimize the size of the thermal printer which does not interfere with the transfer of a print medium while connecting a movable recording head to a main board.

According to an aspect of the present invention, there is provided a thermal printer for a print medium having first and second surfaces opposite to one another. The thermal printer further includes a rotating unit rotatably installed within a frame, a recording head and a support member. A main board is installed on the frame substantially above the first surface of the print medium. The main board applies power and provides image data to the recording head. A flexible cable is disposed on one side or both sides of the print medium so as to not interfere with transfer of the print medium and a reciprocating rotation of the recording head. The flexible cable connects the main board and the recording head. A control guide is located on a path where the flexible cable moves within the frame to control a degree to which the flexible cable is loosened when the recording head is located at a certain position. The recording head forms an image on a print medium by heating a first surface or a second surface of the print medium according to a location to which the recording head is rotated. The support member is installed opposite to the recording head and supports the print medium.

According to another aspect of the present invention, there is provided a thermal printer including a recording head which is rotatably installed within a frame to form an image on a print medium by heating a first surface or a second surface opposite to the first surface, according to a location to which the recording head is rotated. A platen roller is installed opposite to the recording head and forms a nip by supporting the print medium. A support bracket supports the recording head so that the recording head can rotate about a rotating shaft of the platen roller. A driving source provides a rotating force to the support bracket. A main board is installed on the frame substantially above the first surface of the print medium. The main board applies power and provides image data to the recording head. A flexible cable is disposed on one side or both sides of the print medium so as to not interfere with transfer of the print medium and a reciprocating rotation of the recording head. The flexible cable connects the main board to the recording head. A control guide is disposed on a path where the flexible cable moves within the frame and controls a degree to which the flexible cable is loosened when the recording head is located at a certain position.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

Figure 1:
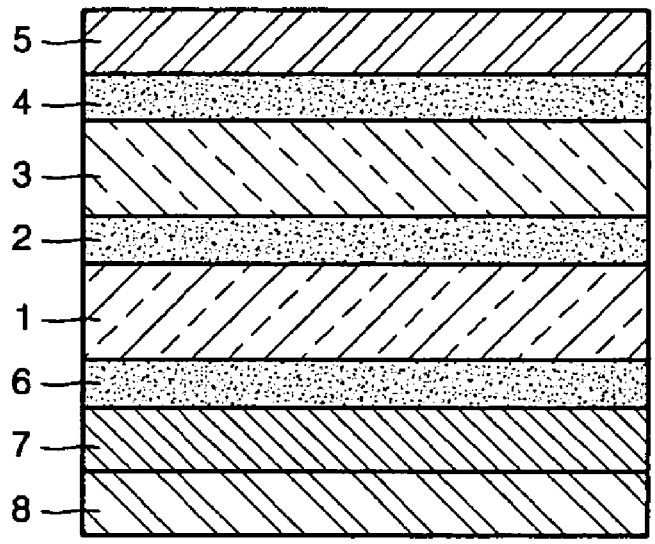
FIG. 1 is a schematic view in cross-section of a thermal imaging print medium.
Figure 2:
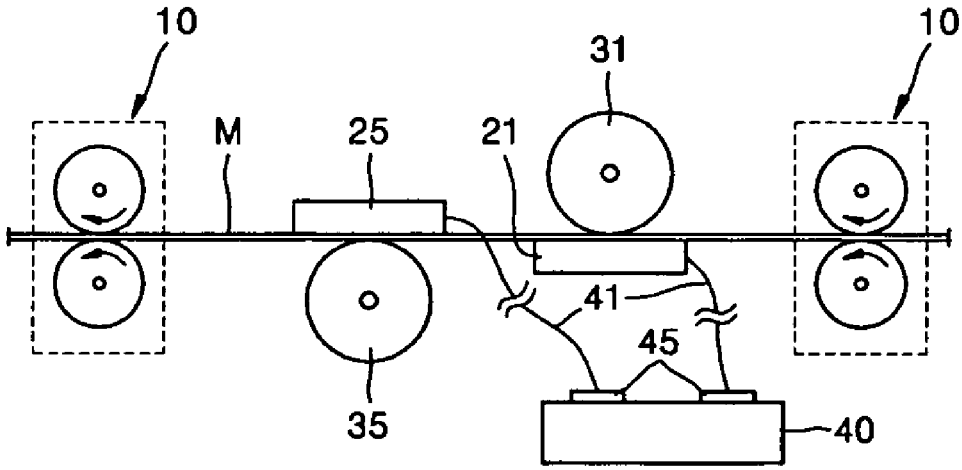
FIG. 2 (PRIOR ART)
FIG. 2 is a schematic view in cross-section of a conventional thermal printer.

The matters defined in the description such as a detailed construction and elements are provided to assist in a comprehensive understanding of the exemplary embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Referring to FIGS. 3 through 6, the thermal printer includes a rotating unit 80, a main board 90, a flexible cable 100, and a control guide 130. The rotating unit 80 is rotatably installed within a frame 70. The main board 90 is fixed onto the frame 70, and the flexible cable 100 connects the rotating unit 80 and the frame 70. The control guide 130 controls a degree to which the flexible cable 100 is loosened when the rotating unit 80 is rotated to a certain location.

A print medium having such a structure as illustrated in FIG. 1 may be used as a print medium 61. An image is formed on the print medium 61 by heating first and second surfaces 61*a* and 61*b* of the print medium 61. The print medium 61 is disposed so that the first and second surfaces 61*a* and 61*b* can move forward and backward along first through third paths while being transferred within the thermal printer. The thermal printer is not limited to the print medium of FIG. 1 and any other type of thermal imaging print media on which double-sided printing is possible may be used.

The first path is a supply path along which the print medium 61 is transferred to the second path. The second path is where the print medium 61 is printed with an image. The third path is a path along which the print medium 61 is finally discharged. A print medium guide 63 guides the print medium 61 and a transfer unit 65 is disposed between the first and third paths. The print medium guide 63 guides the print medium 61 supplied along the first path to the second path. During printing, the print medium guide 63 guides the print medium 61 from the second path to the third path. The transfer unit 65 transfers the print medium 61 from the first path to the second path, from the second path to the third path, or from the third path to the second path according to a stage of printing. A discharge unit 67, including a discharge roller 67*a* and an idle roller 67*b*, engages with the discharge roller 67*a* to discharge the print medium 61, and is disposed on the third path.

The rotating unit 80 includes a recording head 81 and a support member 83. The recording head 81 forms an image on the print medium 61 by heating the print medium 61. The support member 83 is installed opposite to the recording head 81 to support the print medium 61 so that the print medium 61 can thermally contact the recording head 81 during image formation.

Figure 3:
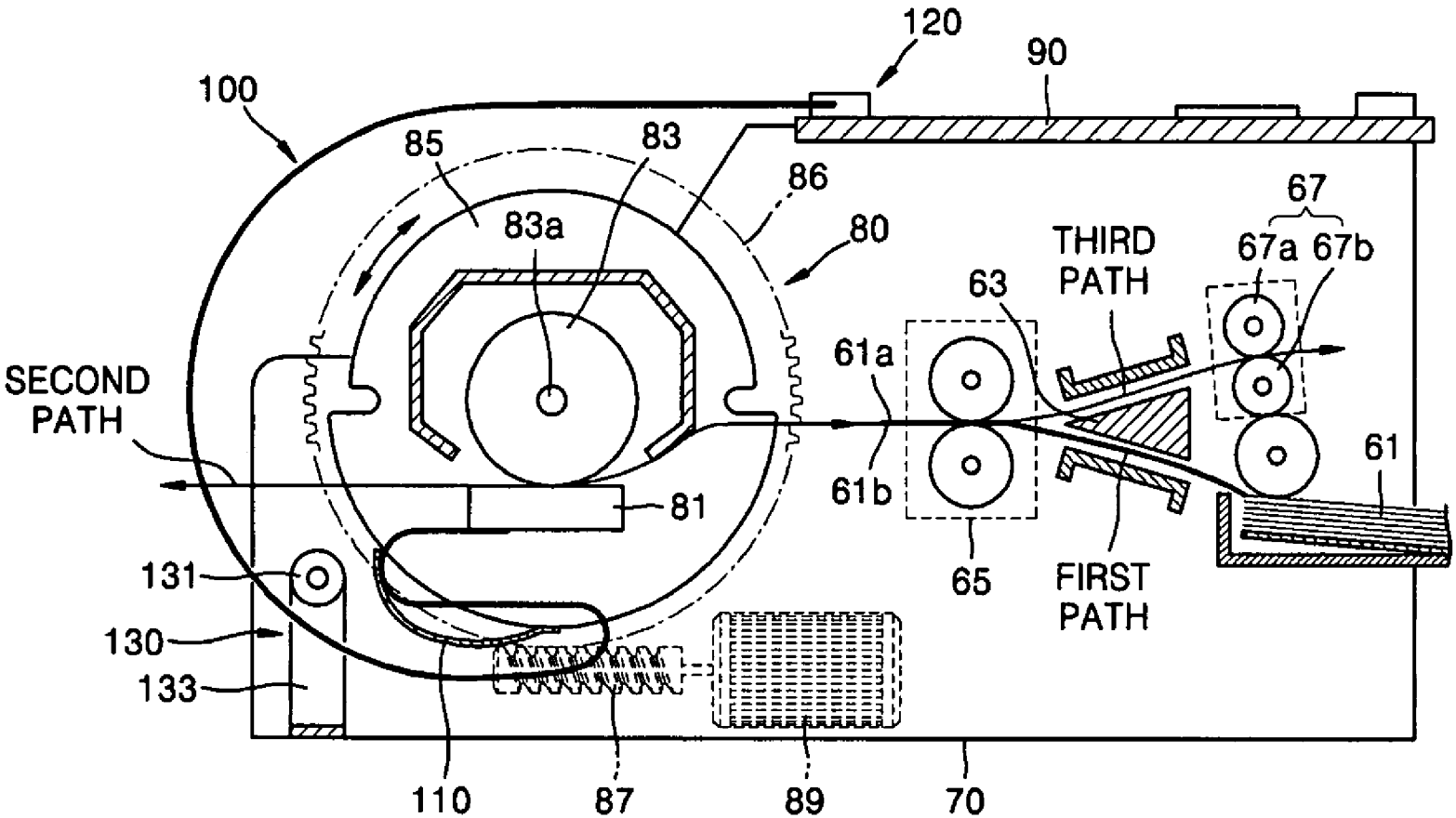
FIG. 3 is a schematic view in cross-section of a thermal printer according to an embodiment of the present invention in one operating state.

The recording head 81 is a thermally recordable head, such as, a thermal print head (TPH), and is rotatably installed within the frame 70. The recording head 81 forms an image by heating either the first or second surface 61*a* or 61*b* of the print medium 61 according to a location to which the recording head 81 is rotated. More specifically, when the recording head 81 is located at a position as illustrated in FIG. 3, an image is formed on the second surface 61*b* of the print medium 61. When the recording head 81 is located at a position as illustrated in FIG. 4, an image is formed on the first surface 61*b* of the print medium 61.

Figure 4:
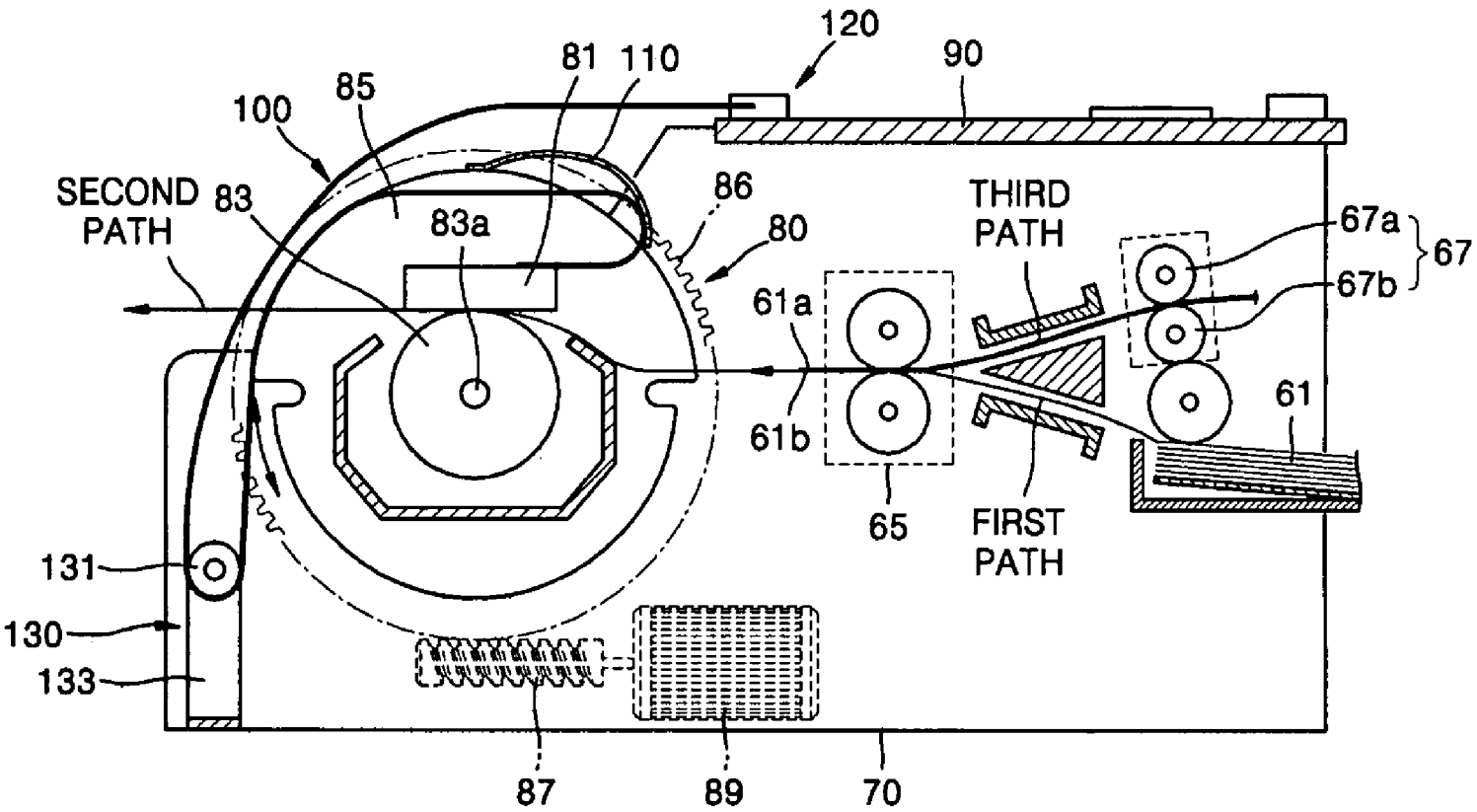
FIG. 4 is a schematic view in cross-section of the thermal printer of FIG. 3 in another operating state.
Figure 5:
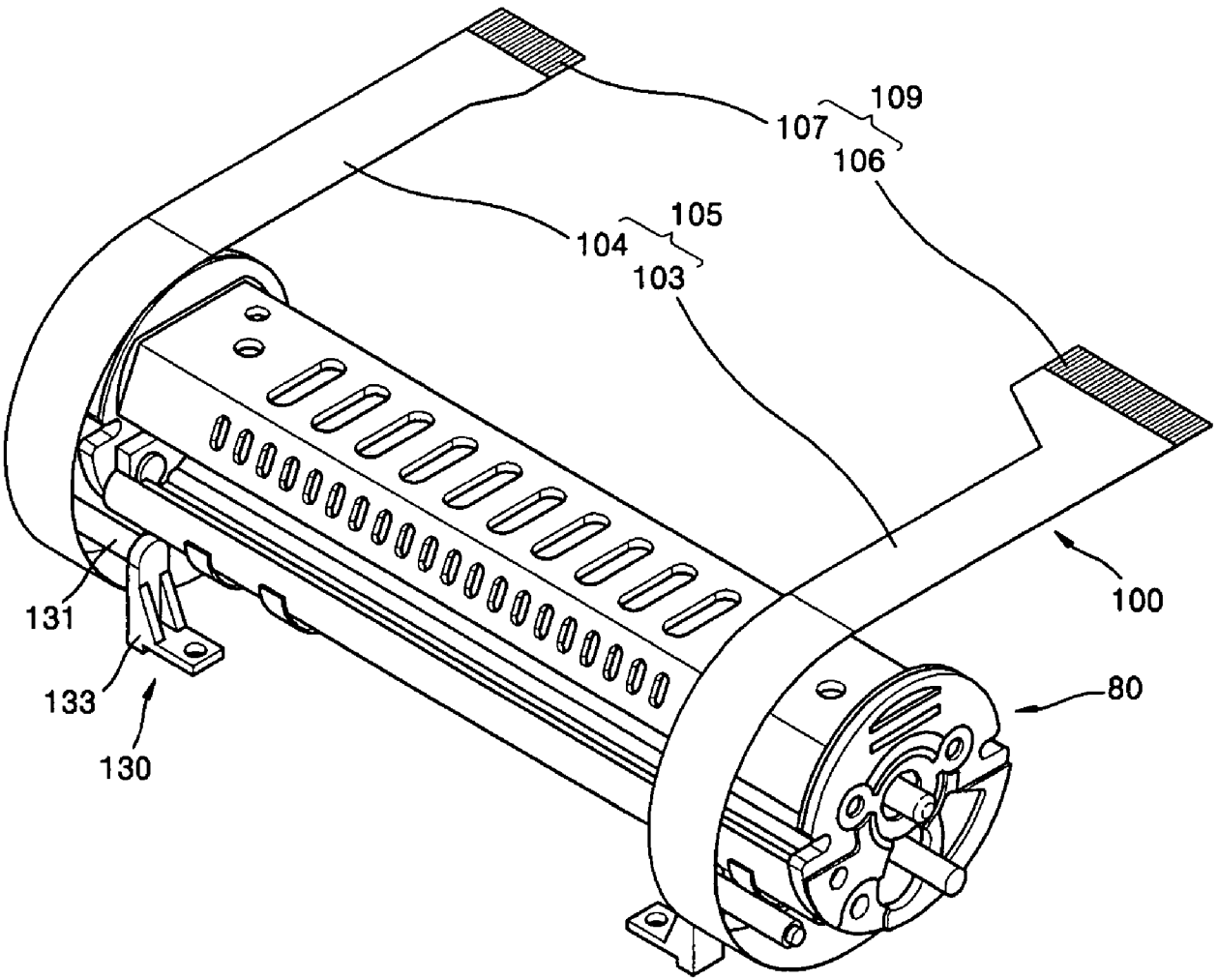
FIG. 5 is a perspective view of the thermal printer illustrated in FIGS. 3 and 4.

The support member 83 may be a platen roller as is illustrated in FIGS. 3 and 4 and forms a nip by supporting the print medium 61.

In this embodiment, the recording head 81 is rotated about a rotating shaft 83*a* of the support member 83 and faces either the first or second surface 61*a* or 61*b* of the print medium 61 according to a location to which the recording head 81 is rotated. To rotate the recording head 81 about the rotating shaft 83*a* of the support member 83, the rotating unit 80 further includes a support bracket 85 for supporting the recording head 81 and a driving source for rotating the support bracket 85. The driving source preferably includes a gear portion 86, a driving motor 89, and a worm gear 87. The gear portion 86 is installed around an outer circumference of the support bracket 85. The worm gear, 87 transmits power of the driving motor 89 to the gear portion 86. The rotating unit 80 is rotated when the print medium 61 does not exist on the second path. In other words, the rotating unit 80 is rotated before the print medium 61 is supplied from the first path to the second path or when the print medium 61 of which the first surface 61*a* has been printed with an image does not yet return to the second path after being transferred to the third path.

The main board 90 is installed on the frame 70 to minimize the size of the thermal printer. The main board 90 applies power and image data to the recording head. 81 via the flexible cable 100.

The flexible cable 100, which connects the main board 90 to the recording head 81, preferably does not interfere at all with the transfer of the print medium 61 along the second path and a reciprocating rotation of the recording head 81. Hence, the flexible cable 100 connects the main board 90 to the recording head 81 via one surface or both surfaces of the print medium 61.

Figure 7:
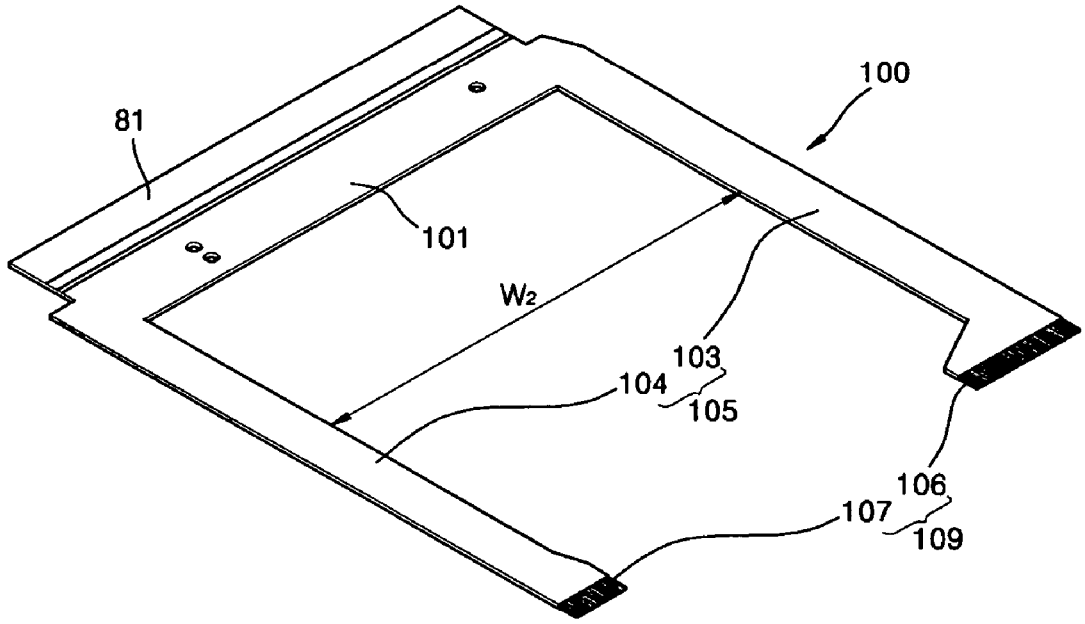
FIG. 7 is a perspective view of a recording head and a flexible cable illustrated in FIG. 3.

Referring to FIG. 7, the flexible cable 100 includes a coupling portion 101, which is coupled to the recording head 81, and a cable portion 105 extending from at least one side of the coupling portion 101. The cable portion 105 electrically and/or optically connects the recording head 81, which is coupled to the coupling portion 101 to the main board 90. The cable portion 105 is formed of an elastic material configured to deform or return to its original shape according to a location to which the recording head 81 is rotated. For example, a flexible printed cable (FPC) having a pattern-shaped wire structure may be used as the flexible cable 100.

Figure 8:
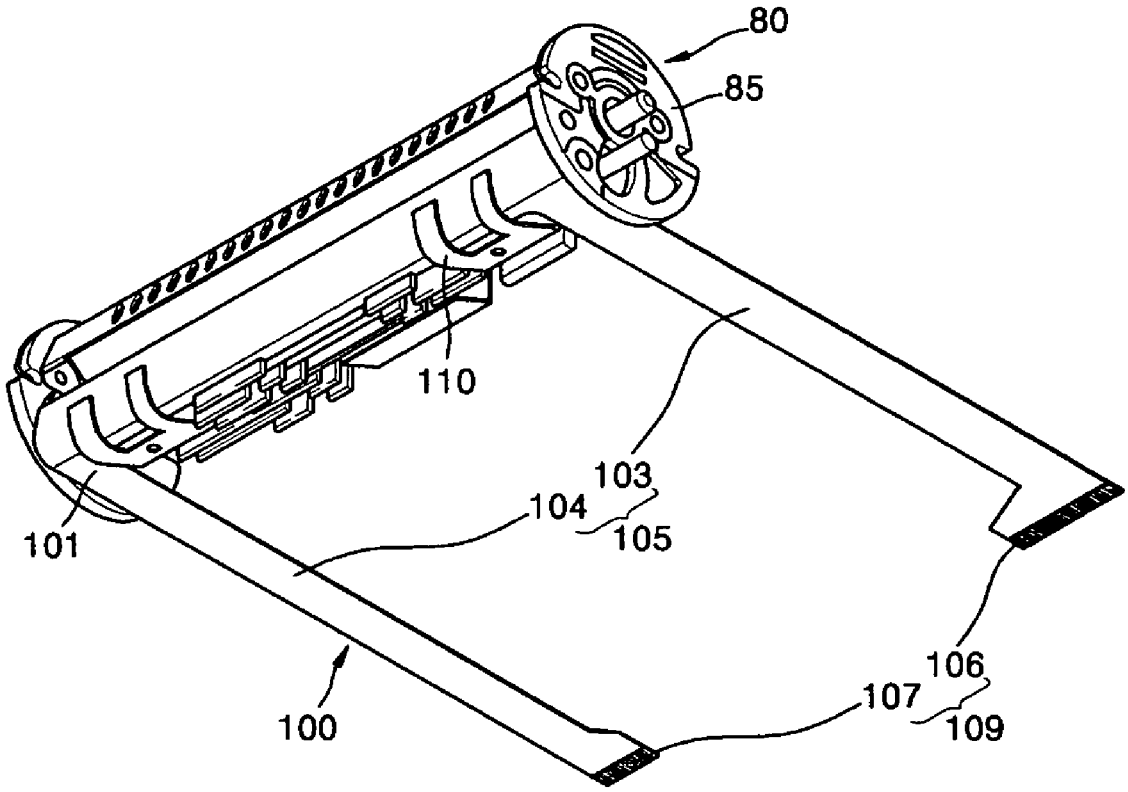
FIG. 8 is a perspective view of a flexible cable fixed onto a rotating unit of FIG. 3 by a fixing holder.

As illustrated in FIGS. 3, 4, and 8, the thermal printer may further include a fixing holder 110 which fixes the coupling portion 101 onto the rotating unit 80. The fixing holder 110, such as an elastic plate, is coupled to the rotating unit 80 so that the coupling portion 101 can adhere to an outer circumference of the rotating unit 80. In this case, that is, when the coupling portion 101 is fixed to the rotating unit 80 by the fixing holder 110. A rotating radius of the flexible cable 100 is reduced compared to when fixing holders are not included in the structure of FIG. 3. Accordingly, the use of the fixing holder 110 contributes to minimizing the size of the printer.

To connect the cable portion 105 to the main board 90, a connector 109 is formed at an end of the cable portion 105. Additionally, a socket 120, which is coupled to the connector 109, is installed on the main board 90. Accordingly, the flexible cable 100 may be detached from the main board 90.

The cable portion 105 has a predetermined length, which is long enough so the cable portion 105 can be connected to the main board 90 and surround the rotating unit 80 when the recording head 81 is located to form an image on the second surface 61*b* of the print medium 61, as shown in FIG. 3.

When the cable portion 105 has such a predetermined length, the cable portion 105 has surplus length when the recording head 81 is located to form an image on the first surface 61*a* of the print medium 61 as shown in FIG. 4. The surplus length of the cable portion 105 is controlled by the control guide 130. The control guide 130 is disposed on a path where the flexible cable 100 moves within the frame 70. More specifically, the control guide 130 is disposed between a center about which the recording head 81 rotates and the flexible cable 100. The control guide 130 is comprised of a control guide portion 131, which contacts the flexible cable 100, and a fixing portion 133, which fixes the control guide portion 131 onto the frame 70.

Due to the installation of the control guide 130, when the recording head 81 is located to form an image on the first surface 61*a* of the print medium 61 as shown in FIG. 4, the flexible cable 100 surrounds an outer circumference of the control guide portion 131 and connects the recording head 81 to the main board 90. Accordingly, the surplus length of the flexible cable 100 can be prevented from ranging over the rotating unit 80 and interfering with the travel of the print medium 61.

Meanwhile, when the recording head 81 is located to form an image on the second surface 61*b* of the print medium 61, as shown in FIG. 3, the flexible cable 100 separates from the control guide 131.

Figure 6:
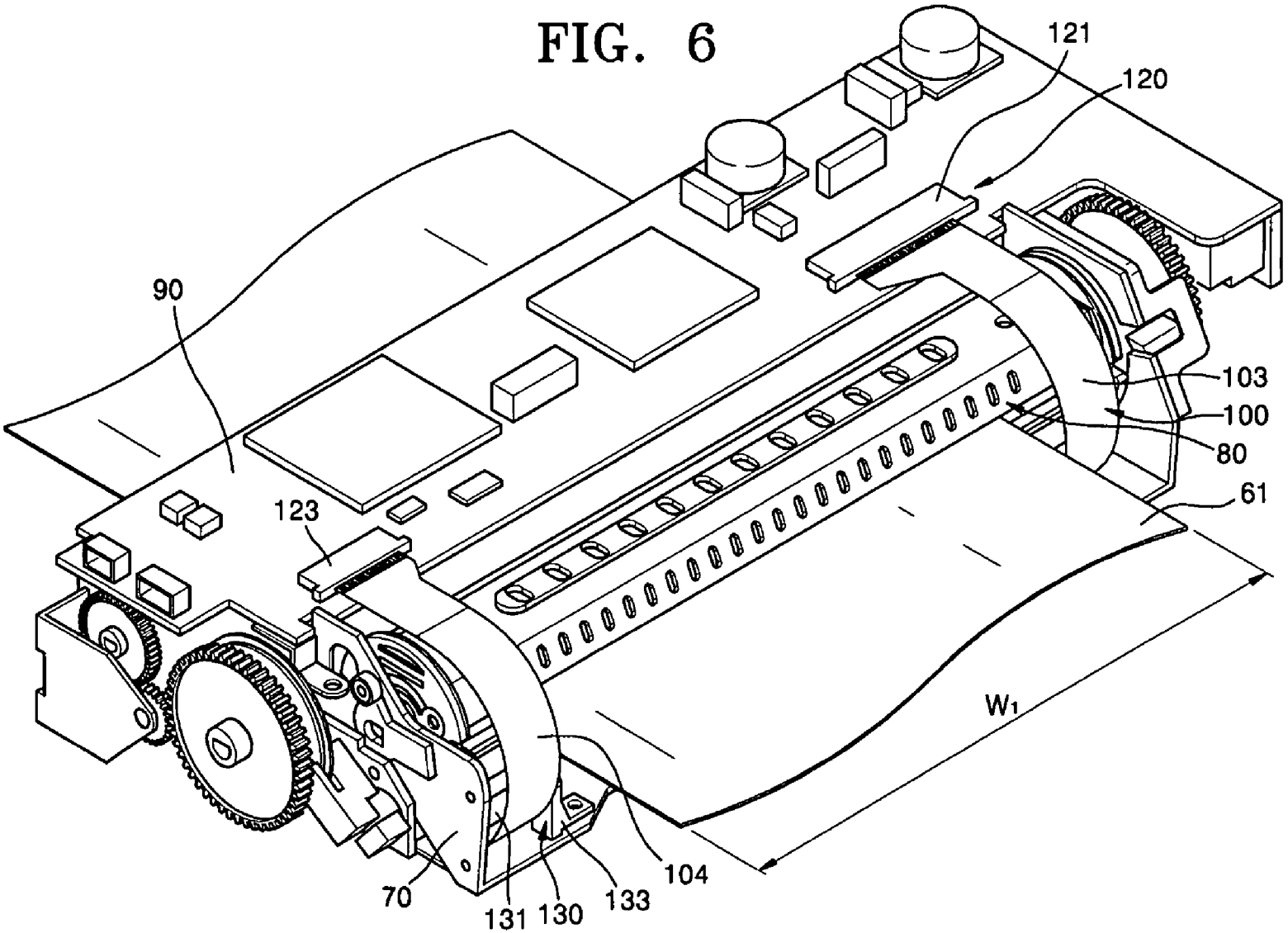
FIG. 6 is another perspective view of the thermal printer illustrated in FIGS. 3 and 4.

Referring to FIGS. 6 through 8, the cable portion 105 is comprised of a first cable portion 103 extending from one end of the coupling portion 101 and a second cable portion 104 extending from the other end of the coupling portion 101, to apply power and image data. The first cable portion 103 is used to apply power to the main board 90, and the second cable portion 104 is used to transmit image data.

Preferably, an interval $W_2$ between the first and second cable portions 103 and 104 is greater than a width $W_1$ of the print medium 61. More preferably, the interval $W_2$ between the first and second cable portions 103 and 104 is about 1-30 mm greater than the width $W_1$ of the print medium 61. Due to the use of the first and second cable portions 103 and 104, the print medium 61 can be transferred through a space between the first and second cable portions 103 and 104 without interference of the flexible cable 100. In this case, the connector 109 is comprised of first and second connectors 106 and 107 formed on ends of the first and second cable portions 103 and 104, respectively. The socket 120 is comprised of first and second sockets 121 and 123 and is attachable to or detachable from the first and second connectors 106 and 107, respectively. The control guide 130 is disposed proximate to the locations of the first and second cable portions 103 and 104.

Since the thermal printer having such a structure uses a single recording head to form an image on both surfaces of a print medium, the thermal printer is minimized in size. In addition, since a flexible cable is disposed at one side or both sides of the print medium to connect the recording head to a main board, the connection structure between the recording head and the main board is minimized, and the flexible cable does not interfere with the transfer of the print medium.

Furthermore, since a portion of the flexible cable is attached to a rotating unit by a fixing holder, a space that the flexible cable occupies can also be reduced.

Also, a control guide is installed to control a degree to which the flexible cable is loosened when a recording head is located at a certain position. Consequently, interference of the loosening flexible cable with the travel of the print medium can be prevented. In addition, the minimization of the connection structure can enhance the quality of an image data signal that is transmitted to the thermal printer and may also greatly reduce emission of electronic waves.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A thermal printer for a print medium having first and second surfaces opposite to one another, the thermal printer including a rotating unit rotatably installed within a frame, comprising:

a recording head which forms an image on the print medium by heating the first surface or a second surface according to a location to which the recording head is rotated; and a support member arranged opposite to the recording head to support the print medium;

a main board located on the frame substantially above the first surface of the print medium, the main board applies power and image data to the recording head;

a flexible cable disposed on one side or both sides of the print medium so as to not interfere with transfer of the print medium and a reciprocating rotation of the recording head, wherein the flexible cable connects the main board and the recording head; and a control guide disposed on a path where the flexible cable moves within the frame to control a degree to which the flexible cable is loosened when the recording head is located at a certain position.

2. The thermal printer of claim 1, wherein the control guide is disposed between a center about which the recording head rotates and the flexible cable.

3. The thermal printer of claim 2, wherein when the recording head is located to form an image on the first surface of the print medium, the flexible cable substantially surrounds an outer circumference of the control guide and connects the recording head to the main board.

4. The thermal printer of claim 1, wherein the flexible cable comprises:

a coupling portion coupled to the recording head; and a cable portion extending from at least one end of the coupling portion to connect the recording head to the main board, wherein the cable portion deforms or returns to the original shape according to a location to which the recording head is rotated.

5. The thermal printer of claim 4, further comprising a fixing holder coupled to the rotating unit to fix the coupling portion onto the rotating unit.

6. The thermal printer of claim 4, wherein the cable portion comprises:

a first cable portion extending from one end of the coupling portion; and a second cable portion extending from the other end of the coupling portion, wherein an interval between the first and second cable portions is greater than a width of the print medium.

7. The thermal printer of claim 6, further comprising:

first and second connectors formed on ends of the first and second cable portions, respectively; and first and second sockets installed on the main board and into which the first and second connectors are inserted, respectively, wherein the flexible cable is attachable to and detachable from the main board.

8. The thermal printer of claim 1, further comprising:

a connector formed on one end of the flexible cable; and a socket installed on the main board and coupled with the connector, wherein the flexible cable is attachable to and detachable from the main board.

9. A thermal printer comprising:

a recording head rotatably installed within a frame which forms an image on a print medium by heating a first surface or a second surface arranged opposite to the first surface, according to a location to which the recording head is rotated;

a platen roller installed opposite to the recording head, forming a nip by supporting the print medium;

a support bracket supporting the recording head so that the recording head can rotate about a rotating shaft of the platen roller;

a driving source providing a rotating force to the support bracket;

a main board installed on the frame over the first surface of the print medium, the main board applies power and provides image data to the recording head; a flexible cable disposed on one side or both sides of the print medium so as to not interfere with a transfer of the print medium and a reciprocating rotation of the recording head, the flexible cable connecting the main board to the recording head; and a control guide disposed on a path where the flexible cable moves within the frame to control a degree to which the flexible cable is loosened when the recording head is located at a certain position.

10. The thermal printer of claim 9, wherein the control guide is disposed between a center about which the recording head rotates and the flexible cable.

11. The thermal printer of claim 10, wherein when the recording head is located to form an image on the first surface of the print medium, the flexible cable substantially surrounds an outer circumference of the control guide and connects the recording head to the main board.

12. A thermal printer for a print medium having first and second surfaces opposite to one another, the thermal printer including a rotating unit rotatably installed within a frame, comprising:

a recording head which forms an image on the print medium by heating the first surface or a second surface according to a location to which the recording head is rotated; and a support member arranged opposite to the recording head to support the print medium;

a main board located on the frame substantially above the first surface of the print medium, the main board applies power and image data to the recording head;

a flexible cable disposed on one side or both sides of the print medium to connect the main board and the recording head; and a control guide disposed on a path where the flexible cable moves.

13. The thermal printer of claim 12, wherein the control guide is disposed between a center about which the recording head rotates and the flexible cable.

14. The thermal printer of claim 12, wherein when the recording head is located to form an image on the first surface of the print medium, and the flexible cable substantially surrounds an outer circumference of the control guide.

15. The thermal printer of claim 12, wherein the flexible cable comprises:

a coupling portion coupled to the recording head; and a cable portion extending from at least one end of the coupling portion.

16. The thermal printer of claim 15, further comprising a fixing holder coupled to the rotating unit.

17. The thermal printer of claim 15, wherein the cable portion comprises:

a first cable portion extending from one end of the coupling portion; and a second cable portion extending from the other end of the coupling portion.

18. The thermal printer of claim 17, further comprising:

first and second connectors formed on ends of the first and second cable portions, respectively; and first and second sockets installed on the main board and into which the first and second connectors are inserted, respectively.

19. The thermal printer of claim 12, further comprising:

a connector formed on one end of the flexible cable; and a socket installed on the main board and coupled with the connector.

* * * * *